US005332023A

United States Patent [19]

Mills

[11] Patent Number: 5,332,023

[45] Date of Patent: Jul. 26, 1994

[54] LEACHING OF CERAMIC MATERIALS

[75] Inventor: David Mills, Bristol, England

[73] Assignee: Rolls-Royce plc, London, Great Britain

[21] Appl. No.: 53,263

[22] Filed: Apr. 28, 1993

[30] Foreign Application Priority Data

May 8, 1992 [GB] United Kingdom ..... 9210008.0
Mar. 15, 1993 [GB] United Kingdom ..... 9305293.4

[51] Int. Cl.[5] ..... B22D 29/00

[52] U.S. Cl. ..... 164/132; 134/2; 134/3; 134/21; 134/22.1; 134/22.17

[58] Field of Search ..... 164/132; 134/2, 3, 19, 134/21, 22.1, 22.17, 22.18, 35

[56] References Cited

U.S. PATENT DOCUMENTS 3,563,711 2/1971 Hammond et al. ..... 164/132 X
3,694,264 9/1972 Weinland et al. ..... 134/2 X
4,043,377 8/1977 Mazdiyasni ..... 164/132 X
4,073,662 2/1978 Borom ..... 164/132 X
4,102,689 7/1978 Borom ..... 164/132 X
4,134,777 1/1979 Borom ..... 164/132 X
4,141,781 2/1979 Greskovich et al. ..... 164/132 X
4,552,198 11/1985 Mills et al. ..... 164/132 X

*Primary Examiner*—J. Reed Batten, Jr.
*Attorney, Agent, or Firm*—Oliff & Berridge

[57] ABSTRACT

The article together with the alumina core in situ is placed in a sealable vessel containing a concentrated aqueous potassium hydroxide leaching liquor at a temperature immediately below its normal atmospheric boiling point. The vessel is sealed and the pressure within the vessel is reduced to less than atmospheric pressure so as to induce boiling and agitation of the leaching liquor within the passage in the article. The pressure in the vessel is raised to atmospheric pressure and finally spent leaching liquor together with leached alumina core is removed from within the article.

16 Claims, 1 Drawing Sheet

LEACHING OF CERAMIC MATERIALS

Figure 1:
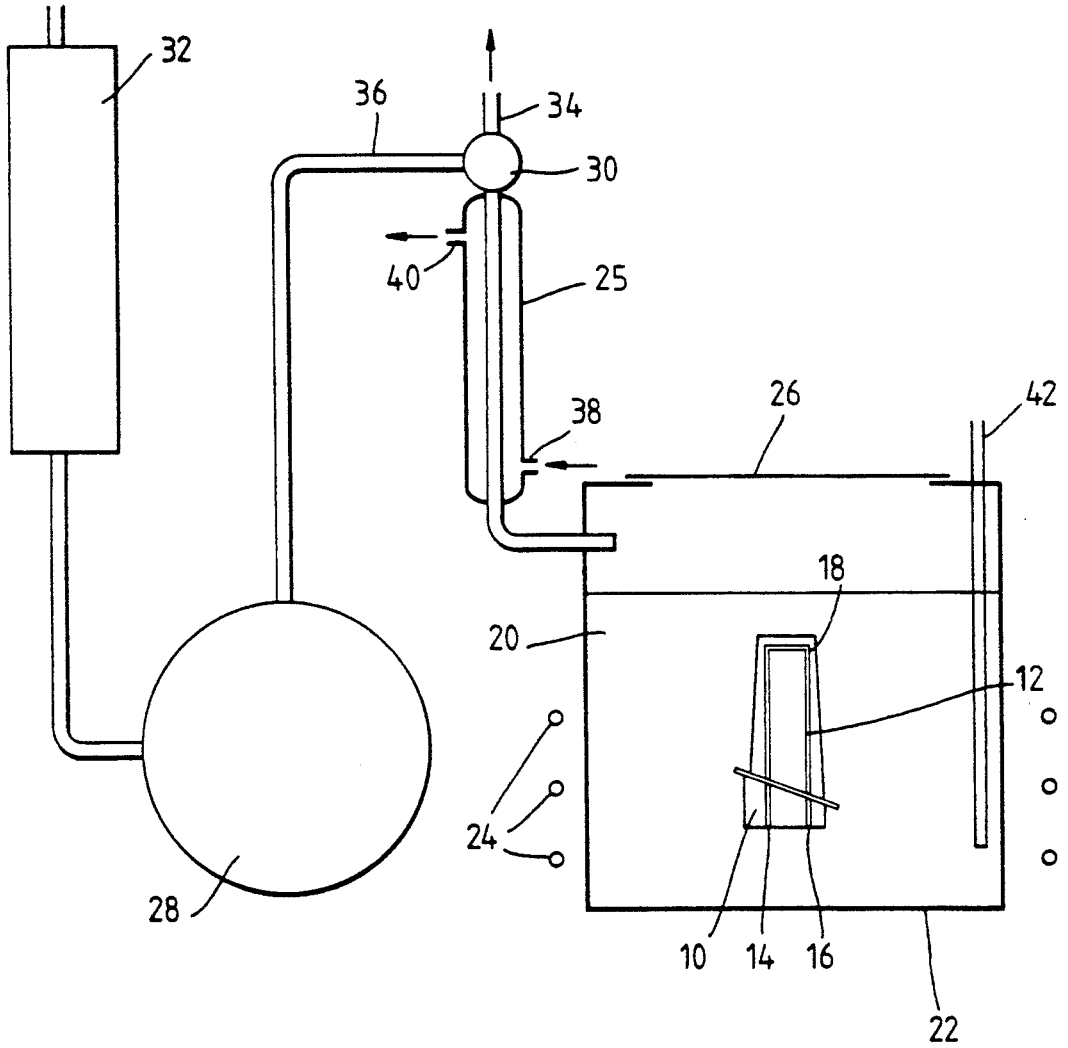

This invention concerns improvements in or relating to the leaching of ceramic materials. In particular, it relates to the leaching of preformed ceramic cores in an investment casting process.

In high performance gas turbine engines, for instance those used in aircraft, certain components such as engine turbine blades are subject to high temperatures which may be near or even above the melting point of the alloy of which the blades are composed. When the engine is operated at high temperatures the blades are cooled by passing relatively cold air through passages within the blades. Consequently, the blades are able to function successfully in a gas stream which is at a temperature above the melting point of the blade material. The ability of a gas turbine engine to run at high temperatures is one of the most important factors controlling its power output. The ability of components such as blades and vanes to withstand high temperatures is therefore of great importance.

The cooling passages within the blades have to be carefully designed in order to achieve their objective and are frequently of labyrinthine complexity. Such complexity can only conveniently be achieved by investment casting techniques around male cores formed in the shape and configuration of the passages that are to be made.

It will be understood that the term "passage" in the context of the present invention implies any hollow portion within an article that has communication with the outside of the article, and includes cavities that have such communication.

In the investment casting of blades it is necessary to fabricate the cores of a material which can not only withstand and be inert to the molten alloy used to cast the blades, but which can subsequently be easily removed so as to form the required passages. Preformed ceramic cores are usually used for this purpose and, although in the simplest cases the ceramic may be removable by mechanical means after the alloy has solidified, in those cases where the passages are of a complex shape and mechanical removal of the core is not possible, it will be necessary to leach or dissolve the ceramic from within the casting.

Hitherto, most preformed ceramic cores for investment casting have been based on silica compositions. The silica is leached out after casting is complete by means of aqueous alkali hydroxides which do not corrode to any significant extent the alloys and superalloys now used in high performance gas turbine engines.

The requirement that the preformed core should be leachable has hitherto restricted the use of other core materials having high temperature properties superior to those of silica.

One such core material is alumina, which possesses desired properties in that it is refractory and chemically inert to molten nickel-based alloys. Alumina is suitable for superalloys and is soluble in aqueous alkali hydroxides, but with slow rates of leaching when compared with silica.

Yet another attractive core material is yttria which is inert to a wide range of casting alloys, including alloys of titanium, aluminium and magnesium. However, the very inertness of alumina and yttria renders these core materials significantly more difficult to remove from labyrinthine passages than core materials based on silica.

Methods of making alumina core bodies which are sufficiently leachable so that they are able to provide a usable leaching time have been disclosed in the prior art.

A first such prior art method uses an alumina core material that has a high porosity but a smooth surface. The prior art suggests that over 50% porosity is required even to approach the conventional leaching times encountered with silica cores. This method is inherently expensive and is not extensively used.

A second prior art method proposes increasing the porosity of the alumina core material by adding carbon as a burn-off additive to the moulding compound in the manufacture of cores, in much the same manner that porous ceramic bricks are made.

I believe that about 50% porosity is the practical limit for easy alumina core manufacture using an additive that can be burned off, and not the higher porosities envisaged by the first prior art method.

When alumina is used as a core material it is necessary in the prior art leaching methods to increase the leaching reaction rate by increasing the activity of the caustic alkali leaching liquor. This is done by using an autoclave. This technique is also used for the removal of silica cores.

There are three commonly used systems for silica core removal, viz:

(1) a 20–40% aqueous sodium hydroxide solution boiling at about 120° C. (at normal atmospheric pressure i.e. 1014 millibar);

(2) a low pressure autoclave operating at about 80 psi (5.6 kg/cm$^2$), at a temperature up to 160° C., with intermittent release of the pressure to boil the solution (i.e. to agitate the liquor);

(3) a high pressure autoclave operating in the range 1000 psi (70 kg/cm$^2$) at about 250° C. to 1500 psi (105 kg/cm$^2$) at 350° C.

I have found that alumina cores with 45–50% porosity are not effectively leached by a silica core removal cycle as typified in methods (1) and (2) above, but that method (3) will remove alumina cores, albeit at a significantly slower rate than for silica. It will be appreciated that method (3) also has the disadvantage that a high pressure autoclave is a significant capital expense and is expensive to operate.

It is an object of the present invention to provide a method of leaching ceramic cores, especially those made of alumina, silica or yttria, that avoids the use of a high pressure autoclave and the expense inherent therein.

According to the present invention there is provided a method of leaching a ceramic material from a passage within an article, the method comprising the steps of, (a) placing the article together with the ceramic material in situ therein in a sealable enclosure, in which there is provided a leaching liquor at a temperature immediately below its normal atmospheric boiling point, (b) sealing the enclosure, (c) for a first period of time, maintaining the liquor in a quiescent state in contact with the ceramic material, (d) reducing the pressure within the enclosure to less than atmospheric pressure so as to induce boiling and agitation of the leaching liquor within said passage within the article for a second period of time, thereby to enhance leaching of the ceramic material within the passage, (e) raising the pressure within the enclosure to atmospheric pressure, and returning the liquor to a quiescent state, (f) removing spent leaching liquor together with leached ceramic material from within the article.

The enclosure may also have access to the external atmosphere via a water cooled condenser.

The method preferably includes repeating steps (c)-(e) at least once before step (f) is carried out.

Preferably, in step (d) the pressure within the enclosure is reduced below atmospheric pressure by no more than 0.45 bar, and typically 0.2 bar.

Preferably, when the ceramic material is based on silica or alumina, the leaching liquor has as its active component an aqueous solution of one or more alkali hydroxide having the formula MOH, where M is selected from the group consisting of lithium, sodium, potassium, rubidium and cesium. The molar ratio of $MOH:H_2O$ is preferably 1.8:1.

Preferably, when the ceramic material is yttria, the leaching liquor has an acid as its active component. The acid may be nitric acid.

The leaching liquor may contain a further component adapted to raise the boiling point of the liquor without otherwise increasing the concentration of the active component.

The further component may be inert, or it may be adapted to enhance the leaching activity of the active component.

The ceramic material may be a prefabricated structure, and may be a core for an investment casting.

The invention will now be described by way of example only with reference to the accompanying diagrammatic FIG. 1 which shows a section through an apparatus for carrying out the invention, together with a longitudinal section through a turbine blade provided with a cooling passage.

Referring to FIG. 1 there is shown in longitudinal section an aero engine turbine blade 10 provided with a internal cooling passage 12 having exits 14, 16 at the root of the blade. For the sake of simplicity the blade and the cooling passage are shown stylised; in practice the cooling passage is likely to be of far more complex configuration.

The blade 10, as illustrated, has been cast in, and subsequently removed from, an alumina faced mould (not shown); but the cooling passage 12 still retains within it an alumina core structure 18 left over from the casting process. In practical terms, if the core shape has any degree of complexity the core will effectively be impossible to remove mechanically and will only be removeable by chemical methods.

The blade 10 is shown immersed in a leaching liquor 20 comprising a composition consisting nominally of 85% by weight of potassium hydroxide and 15% by weight of water (i.e. a molar ratio of $KOH:H_2O$ of about 1.8:1), and contained in a nickel vessel or enclosure 22. The vessel 22 is provided with heating coils 24, a thermocouple 42, and a water cooled condenser 25 with inlet and outlet pipes to allow the flow of cooling water 38,40. The vessel 22 is also provided with a removeable cover 26 to allow access in operation.

The exit end of the condenser 25 is provided with a switchable tap 30 allowing the enclosure 22 to be either open to ambient atmospheric pressure 34 through the condenser, or linked to a vacuum reservoir 28 via the tap. The vacuum reservoir is maintained under vacuum by a conventional water trap and vacuum pump unit 32. By operating the tap 30, the enclosure 22 can either be at atmospheric pressure or at a sub-atmospheric pressure depending on the position of the tap.

In an example, the leaching liquor 20 as specified above was prepared and the enclosure 22 filled with the liquor to a suitable level. Suitable cast blades 10 were placed in a nickel basket, immersed in the liquor 20, and the lid 26 of the vessel sealed down. The liquor 20 was then heated by means of the heating coils 24, the tap 30 being set so that the vessel and its contents were at atmospheric pressure, until the liquor boiled. At the same time as the liquor was being heated the condenser cooling water was turned on to prevent loss of water. The precise boiling point of the liquor was determined by means of the immersed thermocouple 42.

Since alkali hydroxides have a tendency to absorb moisture if supplied in the flake or pellet form it was necessary to adjust the natural boiling point of the liquor either by boiling off some water from the liquor, by stopping the flow of cooling water through the condenser for a short period, or carefully adding more water to the liquor to obtain the desired temperature. Even with an accurately set up chemical composition minor adjustment may be required due to slight variations in atmospheric pressure that may occur. The boiling point aimed for was 225° C. which was found to be sufficient to leach alumina cores.

The temperature of the liquor was then allowed to fall to 213° C., 12° below the set boiling point. The liquor at this temperature started to dissolve the alumina ceramic material at the open ends of the core passages 14,16. This was allowed to continue for 10 minutes. A small reduction in pressure was then applied to the system by changing the tap 30 to the position 36 connecting the vacuum reservoir with the enclosure through the condenser, thereby reducing the pressure to about 0.75 bar.

The reduction in pressure caused the liquor to boil, as could be viewed through a sight glass in the vessel (not shown). This boiling condition was allowed to continue for 16 seconds when the tap 30 was returned to atmospheric pressure, thus creating a further quiescent condition in the liquor.

The procedure of reducing the pressure within the vessel 22 so as to induce boiling of the leaching liquor 20 within the vessel, and maintaining the concentration and predetermined natural boiling point by preventing any moisture from escaping using a condenser, and returning the system back to atmospheric pressure, was then repeated throughout the leaching cycle until the alumina core 18 was completely removed.

I have found that the above exemplified leaching liquor composition of 85:15 potassium hydroxide:water (boiling point 225° C.) is highly active in dissolving alumina. An even higher concentration of the leaching liquor, for example, 90:10 potassium hydroxide:water with a boiling point in excess of 225° C., may also be used, but the chemical activity of such a concentration is so high that it may not be suitable for use with some superalloys and may in fact even corrode stainless steel. I have chosen nickel as the material for the vessel 22 because nickel is resistant to the effects of such high concentrations of potassium hydroxide in the long term.

An alternative alkaline leaching agent to potassium hydroxide may be one or more hydroxides selected from the group consisting of sodium, lithium, rubidium and cesium hydroxides. I have found that a suitable concentration of the alkaline leaching agent to give satisfactory performance when leaching alumina is a molar ratio of hydroxide to water of about 1.8:1. This is equivalent to the following percentage weights of alkaline hydroxide in the aqueous leaching liquor:

| | |
|---|---|
| KOH | 85 |
| NaOH | 80 |
| RbOH | 91 |
| CsOH | 93.75 |
| LiOH | 70.5 |

The high temperature of reaction of the leaching liquor with the alumina before boiling occurs may also be achieved by adding an additive to the leaching liquor. This has the advantage of reducing the amount of alkali hydroxide required whilst raising the boiling point. The additive is preferably chemically inert, and may be an alkali halide such as sodium chloride or potassium chloride. However, circumstances may be envisaged wherein the additive may not be inert and may be chosen to enhance the chemical activity of the leaching liquor. A non-inert additive may for example be another alkali hydroxide.

The principles exemplified above whereby there is provided active concentration of liquor to maintain a high temperature and creating a boil condition to agitate the liquor can also be applied to other ceramics and solvents. For instance, the invention contemplates the acid leaching of a ceramic core material which reacts with acid. One such core material is pure yttria which has desirable high temperature properties and can be used for the casting of reactive metals such as aluminium or magnesium alloys, to which yttria is very inert. Yttria may be leached by acids such as nitric acid.

The choice of a leaching liquor, whether alkaline or acidic, should be made on the twin aims of higher leaching rate and minimum corrosion of the casting. In the case of an acidic leaching liquor it is preferable to choose an acid of relatively low volatility to maintain proper control of the solvent throughout the process.

It should be noted that one of the reaction products of both alkaline and acidic leaching liquors during the leaching process is water. This implies that deep within partially cleared core passages, just where agitation is needed to remove partially spent liquor, the reaction face liquor will be slightly diluted compared to the external bulk of the liquor, and this is progressive as the reaction proceeds. Due to depleted liquor, the reaction will slow down, particularly within deep passages, and the boiling point of the liquor here will be less than the bulk boiling point. By operating a few degrees below the bulk boiling point I can obtain a quiescent condition where a slight system pressure reduction will drive the spent leaching liquor out without excessive boiling of the bulk solution. This has the effect of being able to optimize the time that liquor will be in contact with the exposed core material. By choice of temperature of operation, and reduction in pressure, bulk liquor boil can be avoided if so desired. The pressure may for instance be reduced by anything between 0.2 and 0.45 bar, if required.

The method of the invention, using alkaline hydroxide leaching liquor, may also be used to remove silica cores.

I claim:

1. A method of leaching a ceramic material from a passage within an article, the method comprising the steps of, (a) placing the article together with the ceramic material in situ therein in a sealable enclosure, in which there is provided a leaching liquor at a temperature immediately below its normal atmospheric boiling point, (b) sealing the enclosure, (c) for a first period of time, maintaining the liquor in a quiescent state in contact with the ceramic material, (d) reducing the pressure within the enclosure to less than atmospheric pressure so as to induce boiling and agitation of the leaching liquor within said passage within the article for a second period of time, thereby to enhance leaching of the ceramic material within the passage, (e) raising the pressure within the enclosure to atmospheric pressure, and returning the liquor to a quiescent state, (f) removing spent leaching liquor together with leached ceramic material from within the article.

2. A method as claimed in claim 1 wherein in step (d) the pressure within the enclosure is reduced below atmospheric by no more than 0.45 bar.

3. A method as claimed in claim 2 wherein the pressure is reduced below atmospheric by about 0.25 bar.

4. A method as claimed in claim 1 wherein, when the ceramic material is based on alumina or silica, the leaching liquor has as its active component in aqueous solution an alkali hydroxide having the formula MOH, where M is selected from the group consisting of lithium, sodium, potassium, rubidium and cesium.

5. A method as claimed in claim 4 wherein the molar ratio of $MOH:H_2O$ is 1.8:1.

6. A method as claimed in claim 1 wherein, when the ceramic material is yttria, the leaching liquor has an acid as its active component.

7. A method as claimed in claim 6 wherein the acid is nitric acid.

8. A method as claimed in claim 1 wherein the leaching liquor contains a further component adapted to raise the boiling point of the liquor without otherwise increasing the concentration of its the active component.

9. A method as claimed in claim 8 wherein the further component is an inert substance.

10. A method as claimed in claim 8 wherein the further component is adapted to enhance the leaching activity of the active component.

11. A method as claimed in claim 9 wherein the further component is an alkali halide.

12. A method as claimed in claim 11 wherein the alkali halide is selected from the group consisting of sodium chloride and potassium chloride.

13. A method as claimed in claim 1 including repeating steps (c)-(e) at least once before step (f) is carried out.

14. A method as claimed in claim 1 wherein the ceramic material is a prefabricated structure.

15. A method as claimed in claim 14 wherein the prefabricated structure is a core for an investment casting.

16. A method as claimed in claim 1 wherein the enclosure is provided with access to the external atmosphere via a water cooled condenser.

* * * * *